US005083404A

United States Patent [19]

Schulte

[11] Patent Number: 5,083,404

[45] Date of Patent: Jan. 28, 1992

[54] EARTHQUAKE SUPPORT FOR STRUCTURE HAVING BOTTOM BEAMS

[76] Inventor: Henry E. Schulte, 16222 Monterey La. #260, Huntington Beach, Calif. 92649

[21] Appl. No.: 595,304

[22] Filed: Oct. 19, 1990

[51] Int. Cl.[5] ..... E02D 27/34

[52] U.S. Cl. ..... 52/167 R; 52/DIG. 11

[58] Field of Search ..... 52/167 R, 169.8, 169.9, 52/299, 480, 23, DIG. 11

[56] References Cited

U.S. PATENT DOCUMENTS

| | | | |
|---|---|---|---|
| 2,236,091 | 3/1941 | Fletcher | 52/169.9 X |
| 2,429,381 | 10/1947 | Watson | 52/169.9 X |
| 3,724,151 | 4/1973 | Kaywood et al. | 52/23 X |
| 4,010,584 | 3/1977 | Barnes, Jr. | 52/299 |
| 4,864,785 | 9/1989 | Schneider | 52/299 X |

OTHER PUBLICATIONS

"Webster's New International Dictionary", Second Edition, 1941, p. 625.

*Primary Examiner*—Richard E. Chilcot, Jr.
*Assistant Examiner*—Wynn Wood
*Attorney, Agent, or Firm*—Barry A. Bisson

[57] ABSTRACT

A support to provide earthquake resistance for structures, such as a mobile home, which have a long metal bottom beam on the underside of the structure, can be provided by a system of long wooden cross beams at about right angles to the bottom beams, where the cross beams rest on at least two units of cribbing. The cribbing can itself rest on a bottom platform, a pad, or the ground. A bottom platform can function as a shim or leveling device. The cribbing can consist of two or more layers of elongated blocks, such as rough cut 6"×8" or 8"×8" wooden timbers. The cribbing units can be attached to themselves and to the main beam by metal anchors and ties, and the main beam can be attached to the bottom beam of the supported structure by metal clamps.

8 Claims, 3 Drawing Sheets

EARTHQUAKE SUPPORT FOR STRUCTURE HAVING BOTTOM BEAMS

FIELD OF THE INVENTION

The invention relates to supports for structures having long beams on their undersides, such as the longitudinal support beams found on mobile homes.

BACKGROUND OF THE INVENTION

Structures, such as mobile homes, movable storage units, and cargo containers, which contain long support beams on their underside can suffer substantial structural damage from earthquakes. Typically, mobile homes or prefabricated home units contain at least two longitudinal metal beams which provide structural support for the floor of the home and also are needed when the structure is transported on a highway.

Frequently, the home is placed on a lot, and leveling jacks are positioned underneath the home and in contact with the longitudinal support beam and ground or pad, typically poured concrete.

During an earthquake, leveling jacks can collapse or vibration can cause the mobile home to move off the leveling jacks.

The longitudinal beams on the underside of the mobile home can be I-beams or C-beams or fabricated channels. The leveling jacks are typically a pier structure comprising a lower cement pylon in contact with the ground or pad, and an upper leveling screw which is in contact with the bottom of the metal beams.

Prior art efforts to provide an earthquake resistant support are shown in U.S. Pat. Nos. 4,864,785; 4,562,673; 4,546,581; 4,522,000; 4,417,426; 4,373,307; 4,348,843; 4,261,149; 2,344,383; 3,751,866; and 3,830,024.

In general, the prior art supports are complex and costly to fabricate and install, are susceptible to bending or buckling, and do not adequately compensate for the lateral motion of the mobile home. Many of the prior art supports are primarily constructed of metals which are susceptible to corrosion in the environment found under mobile homes. Many of the prior art structures cannot obtain governmental approval, such as the registration required by the Department of Housing and Community Development in the State of California.

The present invention provides a relatively simple structure comprising cribbed piers and crossed main beams and can provide effective support to minimize or eliminate damage to the mobile home from earthquake tremors and is economical and simple to construct and install. The present invention is an earthquake support for a structure having at least two bottom beams on the underside of the structure, where each bottom beam extends for a sufficient length of the structure to provide structural support for the underside, or floor, of the structure, particularly where the structure is designed to be transported on a public highway. Such structures include mobile homes, prefabricated housing units, containers and storage sheds.

The cribbed pier and crossed main beam structure of the present invention provides better earthquake support than do the stacked members of U.S. Pat. No. 4,864,785.

BRIEF SUMMARY OF THE INVENTION

The earthquake support of the present invention can be described as a system of cribbing and cross main beams. Preferably the invention comprises at least two main beams and sufficient cribbing units to provide at least two cribbing units for each main beam. The supported structure must have at least two bottom support beams. The main beam is positioned across the bottom beam of the supported structure, preferably substantially at about 90 degree angles to the bottom support beams and is of sufficient length that at least two of the bottom support beams can rest on the cross main beam.

A preferred embodiment is an earthquake support for a home, where the home has at least two bottom metal beams under the floor of the home and each metal beam extends substantially the length of the floor. Typically the home is supported on a conventional leveling pier structure between the metal beams and a pad or ground. Preferably the earthquake support comprises at least two main beams and sufficient cribbing units to provide at least two cribbing units for each main beam and the main beam extends for substantially the width of the home and substantially directly under the metal beams. Usually the leveling pier structure will comprise a multiplicity of leveling jacks. Typically the leveling jack comprises a lower concrete pylon and an upper screw device which is in contact with the metal beam. Preferably the cribbing units are attached to a platform unit, which is substantially in contact with the pad or ground. The platform unit can be designed to also act as a shim; however, additional shims are usually required to insure good contact between the ground or pad, the support unit, and the metal beam.

Preferably the cribbing units comprise a plurality of elongated blocks (such as conventionally available 6"×8" or 8"×8" chemically treated wood timbers), and at least two of the blocks are substantially horizontal at substantially right s angles above and connected with at least two perpendicular elongated blocks.

Preferably the perpendicular and horizontal elongated blocks are connected by prior art framing devices, such as anchors or hurricane ties. In a support for a mobile home, each cribbing unit comprises 5 members where two horizontal members are above and connected to three perpendicular members, the cross members being substantially in contact with the ground or pad, or are connected to a leveler platform, which is in contact with the pad or ground. The main beam can be attached to the metal bottom beam of the mobile home by the clamping device described hereinafter.

BRIEF DESCRIPTION OF THE DRAWINGS

FIG. 7 shows the bottom metal beam as a fabricated beam with a lip, FIG. 8 shows a metal I-beam, and FIG. 9 shows a main beam consisting of channel iron (or a C-beam).

DETAILED DESCRIPTION OF A PREFERRED EMBODIMENT

Figure 1:
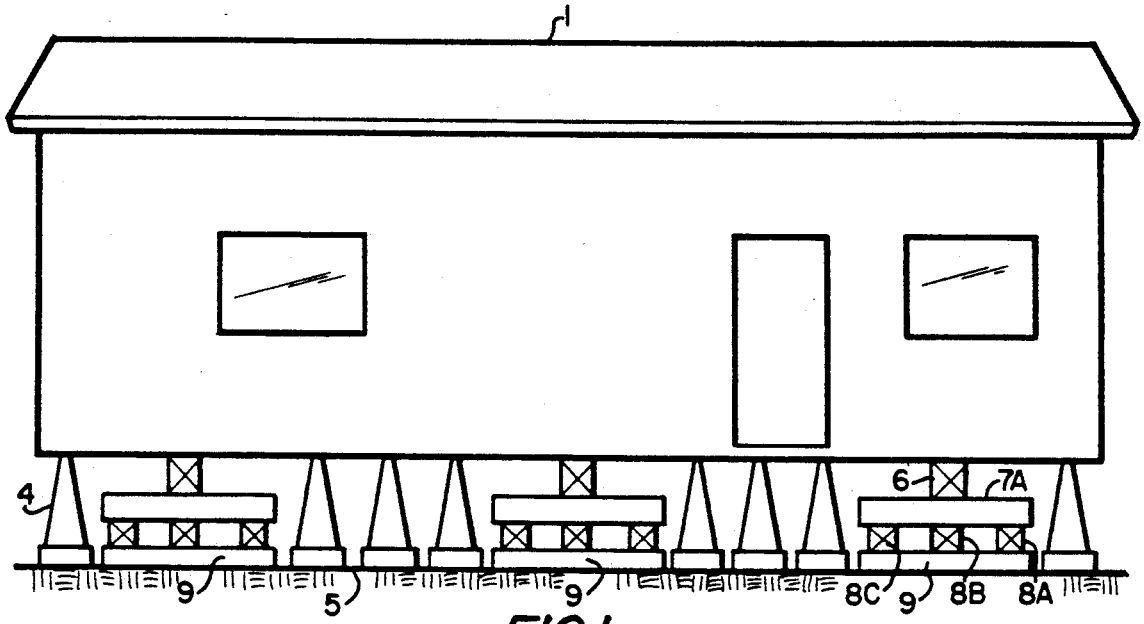
FIG. 1 is an end view of a mobile home showing the bottom metal beams running longitudinally along the bottom floor of the home and shows a preferred earthquake support structure of the present invention positioned between the bottom of the metal beams and a pad on the ground, such as concrete.
Figure 2:
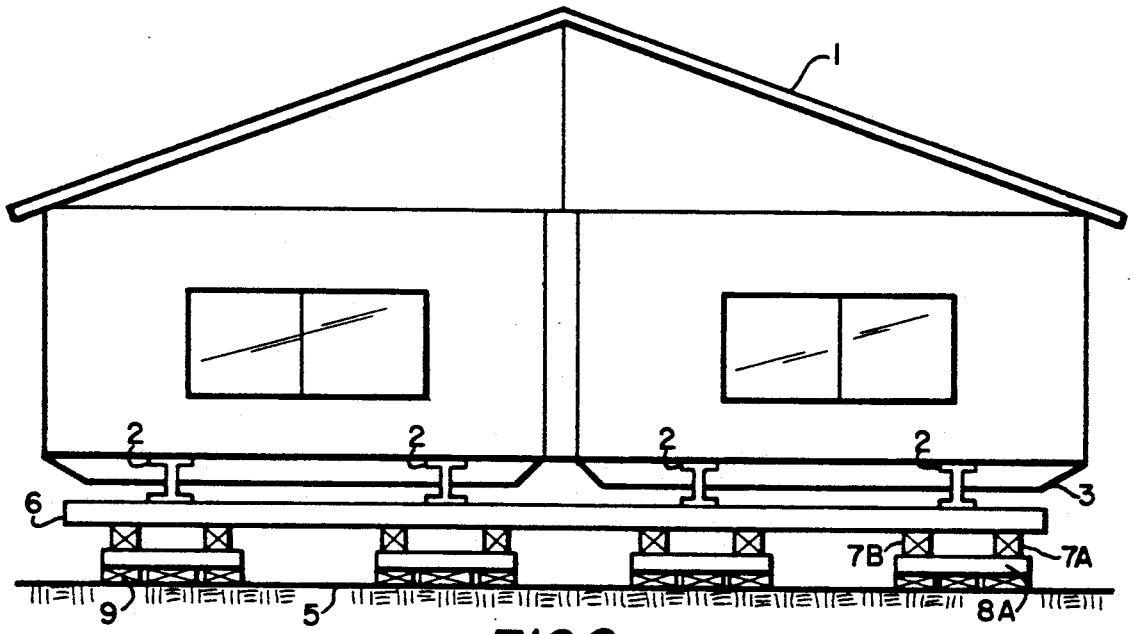
FIG. 2 is a side view of the mobile home and shows how the bottom metal beams are supported on a conventional pier structure comprised of leveling jacks comprising screws and pylons and also shows three earthquake support structures of the present invention, positioned between the metal beams and the concrete pad.

In the accompanying diagrams, FIGS. 1 and 2 depict an earthquake support for a home 1, having at least two metal beams 2, under the floor 3, of said home, each metal beam extending substantially the length of said floor, and wherein said home is supported on a pier structure 4, present between said metal beams and a pad 5, or the ground; said earthquake support comprising at least two main beams 6, and sufficient cribbing units 7*a*, 7*b*, 8*a*, 8*b*, 8*c*, to provide at least two cribbing units for each main beam, and wherein each main beam extends for substantially the width of said home and substantially directly under said metal beams.

The pier structure comprises a multiplicity of leveling jacks 4.

FIG. 1 represents an end view of a mobile home 1, s supported by a plurality of longitudinal metal I-beams 2, said I-beams being connected to an earthquake support of the present invention, said earthquake support comprising at least two main beams 6, and sufficient cribbing units 7A, 7B, 8A, 8B, 8C to provide at least two cribbing units for each main beam. FIG. 2 depicts a side view of the mobile home and the earthquake support structure.

The cribbing units are attached to a platform unit 9, said platform unit being substantially in contact with the pad or ground.

Each cribbing unit comprises a plurality of elongated blocks 7, 8, at least two 7*a*–7*b*, said blocks being stacked horizontally at substantial right angles above and connected with at least two perpendicular elongated blocks 8*a*, 8*b*, 8*c*.

Figure 3:
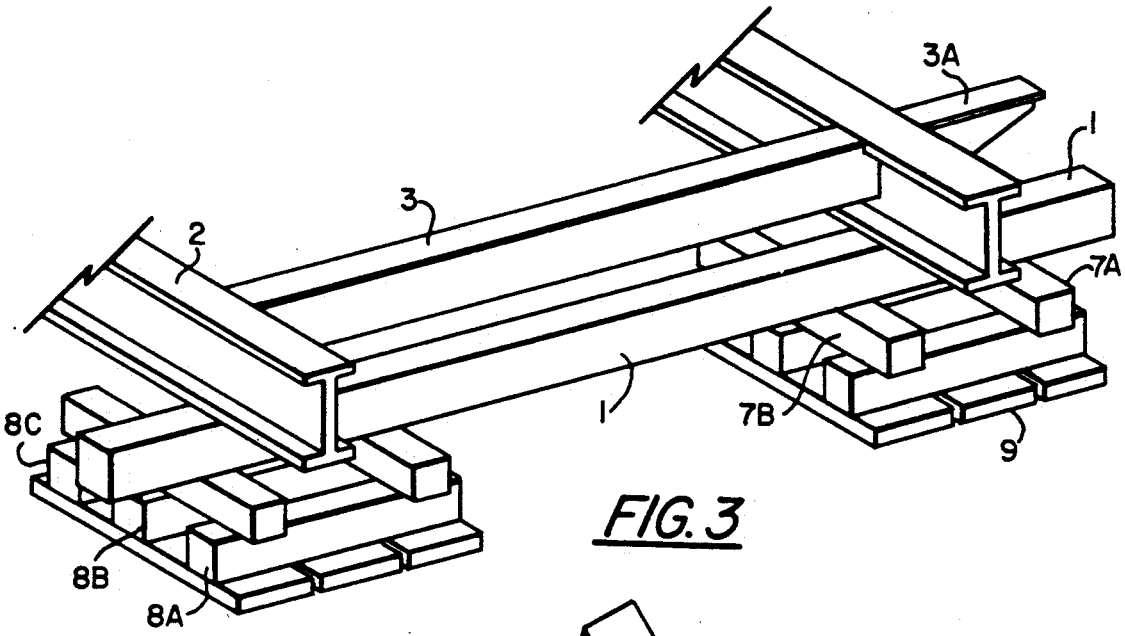
FIG. 3 is a partial isometric view of the earthquake support structure according to the present invention and including a platform attached to the bottom of the cribbing.
Figure 4:
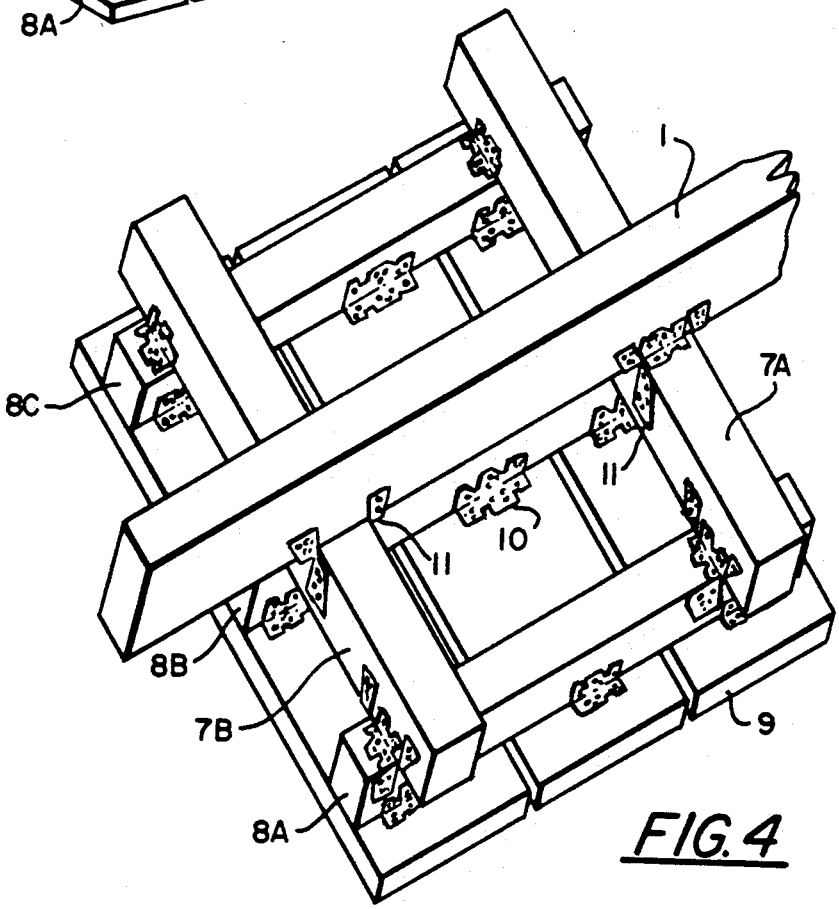
FIG. 4 is a partial isometric view showing an earthquake support unit according to the present invention and shows how the support unit is positioned beneath the metal beam (here an I-beam) and shows cross members with an outrigger connected to the two I-beams.

FIGS. 3 and 4 show horizontal 7*a*, 7*b*, and perpendicular elongated blocks 8*a*, 8*b*, 8*c*, which are connected by framing anchors 11 or hurricane ties 10.

In FIGS. 3 and 4, each cribbing unit comprises five members, wherein said two horizontal members 7*a*, 7*b*, are above and connected to three perpendicular members 8*a*, 8*b*, and 8*c*, said perpendicular members being substantially in contact with the ground or pad. Preferably one of the perpendicular members 2, is in a position substantially beneath the main beam and parallel thereto. An outrigger 3A is connected to the main metal beam 3 to help support the floor of the home.

The three perpendicular members are connected to a leveler platform 9, which is in contact with said pad or ground.

Figure 5:
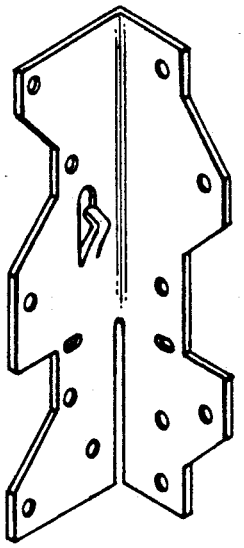
FIG. 5 (PRIOR ART)
FIGS. 5 and 6 show two forms of anchors which can be used to connect the elongated members of the cribbing and also to connect with the cribbing unit to the main beam unit of the present invention.
Figure 6:
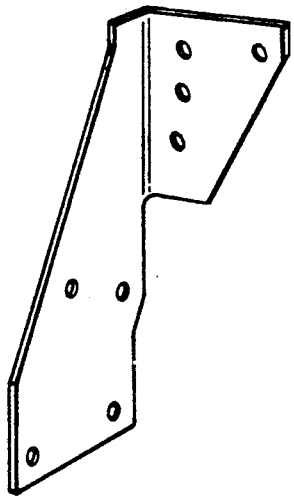
FIG. 6 (PRIOR ART)
Figure 7:
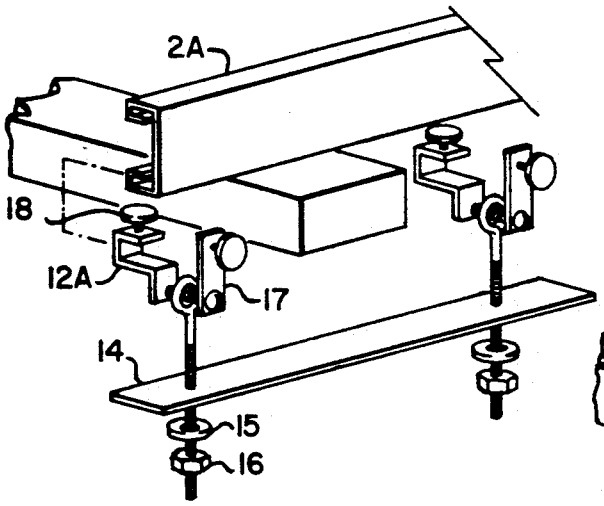
FIGS. 7, 8, and 9 show, respectively, a clamping device comprising clamp units which can be used to attach the s main beam to the bottom metal beam of a mobile home.

FIGS. 5, 6, and 7 illustrate a preferred means of attaching the wooden main beam to the bottom metal beam of the home.

FIG. 5 shows a prior art anchoring device known as a framing anchor which is useful in connecting the elongated members of the cribbing to each other and FIG. 6 shows an anchoring device known as a seismic anchor which can be used to connect the cribbing unit to the main beam unit of the earthquake support of the present invention.

FIG. 7 illustrates a so-called fabricated beam, in a substantially C configuration and having upper and lower lips at the extremities of the channel. The metal beam is attached to the main beam by means of a which can fit over the lip and which can be further secured to the lip by an optional set screw 18. The clamp 12*a*, is attached to a metal bar 17, by means of a nut and bolt 19, and can be further secured by an optional set screw 18. The clamp 12*a*, is connected to an eye bolt 13, by a nut which goes through a hole in the bottom of the bar 17, into a corresponding hole in the clamp, then through the eye of the eye bolt 13, and then through a hole in the bottom of the clamp 18.

The threaded opposite end of the eye bolt goes through a hole in a metal bar 14, to which it is secured by a washer 15, and nut 16,. This device and the related devices of FIGS. 8 and 9, have not heretofore been used in securing support beams to the bottom metal beams of housing units.

Figure 8:
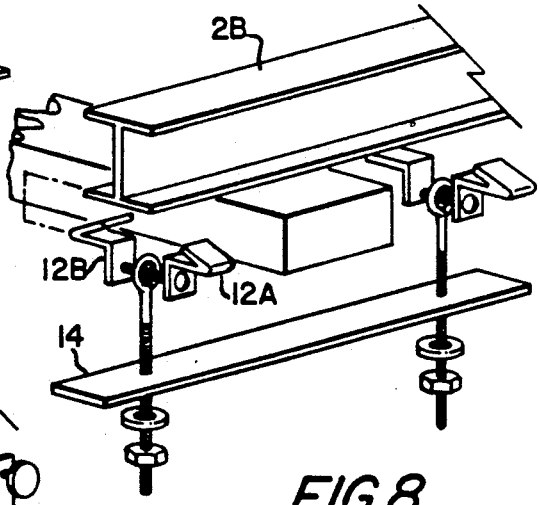
Figure 9:
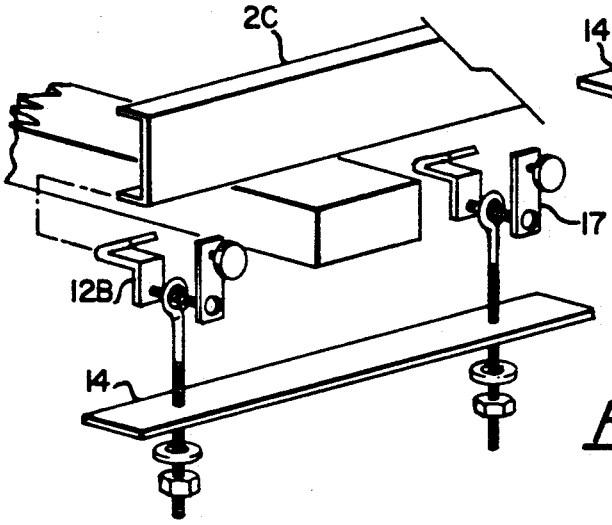

The device of FIG. 8 is similar to that of FIG. 9, but utilizes two tapered clamps 12*b*, to attach on each side of the metal I-beam. Since there is no lip to the I-beam, clamp 12*b* is preferably at an angle similar to the angle of the bottom of the I-beam and of sufficient size to enable a snug fit on the I-beam where the clamp units 12*b*, are brought together by tightening the nut and bolt 19.

In FIG. 9, a Conventional C-beam or channel iron, is secured by a device similar to that of FIG. 7, except that the angle of the clamp 12*b*, is substantially the same as the taper of the walls or lower portion of the C-beam.

The device of FIGS. 3 and 4 was submitted to the e California Department of Housing and Community Development and was found to meet the requirements of California Administrative Code Title 25, Chapter 2, Article 7.5 and granted Registration Number IC 2000.

EXAMPLE

An earthquake resistant support system was constructed for a heavy mobile home of about 24 feet wide and about 60 feet long, using the support system shown in FIGS. 1, 2, 3 and 4 herein. The mobile home is the type known as "double wide"; that is, it comprises two 12 foot wide sections which are separately transported to and joined together at the home site. Each 12 foot section has two bottom metal I-beams having channels of about 12 inches wide with lips extending about 3 inches in each direction from each channel. Each I-beam extends for substantially the entire length of the mobile home.

The main wooden beam of the earthquake supports is constructed from 12 ft. by 8"×8" timbers, which is supported upon cribbing made by cross stacking two 6"×6" elongated wood members (e.g., about 32 inches long), which are directly under and at right angles to the main beam. The bottom of the cribbing is made of three 4"×6" elongated wood members resting on and attached to a wooden platform of about 3 foot square made from three 2"×12"×36" wood boards.

Each cribbing unit is held together by 24 metal "hurricane ties" or seismic anchors and 12 metal framing anchors (e.g. the seismic anchors sold under the trademark SIMPSON STRONG-TIE* ® H5 of about $2\frac{1}{8}''\times4\frac{1}{4}''\times1\frac{1}{2}''$ and the framing anchor sold under the trademark SIMPSON STRONG-TIE ®A35, 1 7/16"×4½"×1 7/16"). The upper portion of the cribbing is connected to the main beam by 8 seismic anchors and 4 metal framing anchors. The platform is connected to the bottom of the cribbing by about 18 framing anchors.

*STRONG TIE ® is a registered trademark of SIMPSON STRONG-TIE COMPANY, INC., San Leandro, Calif.

Each main beam of the earthquake support is attached at right angles to each two metal beams by means of two sets of clamp-eyebolt-bar units shown in FIG. 8.

All wood is chemically treated with a preservative such as ammoniacal copper arsenate or copper zinc arsenate or chromated copper arsenate or copper naphthenate, etc. All metal parts have been treated to resist corrosion (e.g. hot-tumbled, hot-dipped, galvanized stainless steel silicon-bronze or copper fasteners can also be used.

What is claimed is:

1. An earthquake support for a home, said home having at least two metal beams under the floor of said home, each metal beam extending substantially the length of said floor, and wherein said home is supported on a pier structure present between said metal beams and a pad or the ground and comprising a multiplicity of leveling jacks; said earthquake support comprising at least two main beams and sufficient cribbing units to provide at least two cribbing units for each main beam and wherein each main beam extends for substantially the width of said home and substantially across and directly under said metal beams, and wherein at least one said cribbing unit is attached to a platform unit, said platform unit being substantially in contact with the pad or ground.

2. The earthquake support structure of claim 1, wherein said cribbing unit comprises a plurality of elongated blocks, at least two said blocks being positioned horizontally at substantial right angles above and connected with at least two perpendicular elongated blocks.

3. An earthquake support according to claim 2, wherein said perpendicular and horizontal elongated blocks are connected by metal framing anchors or metal hurricane ties.

4. An earthquake support according to claim 2, wherein each said cribbing unit comprises five members, and wherein said two horizontal members are above and connected to three lower perpendicular members, said perpendicular members being substantially in contact with the ground or paid.

5. An earthquake support according to claim 4, wherein said three perpendicular members are attached to said platform which is in contact with said pad or ground.

6. An earthquake support according to claim 1, wherein said home is a mobile home having at least four of said metal beams.

7. An earthquake support according to claim 1, where said main beam and said cribbing units are comprised of wood.

8. An earthquake support according to claim 1, wherein the main beam is connected to metal beam, by means comprising at least one clamp and two eye bolts having an eye on one end and bolt threading on the opposite end, said clamp being attached to the eye of the eye bolt, and the threaded end of the eye bolt being connected by a nut to a metal bar, said metal bar extending across the bottom of the main beam.

* * * * *